United States Patent [19]

Anderson et al.

[11] 4,097,918

[45] Jun. 27, 1978

[54] ILLUMINATED SPACE DIVIDING WALL PANEL SYSTEM

[75] Inventors: William C. Anderson, Grand Rapids; Gordon J. Cooper, Alto; Charlie R. Tyke, Cascade, all of Mich.

[73] Assignee: Westinghouse Electric Corp., Pittsburgh, Pa.

[21] Appl. No.: 797,894

[22] Filed: May 17, 1977

[51] Int. Cl.[2] ..... F21S 1/02

[52] U.S. Cl. ..... 362/147; 362/220; 362/430

[58] Field of Search ..... 240/2 R, 6.4; 362/147, 362/220, 430

[56] References Cited

U.S. PATENT DOCUMENTS 3,389,246 6/1968 Shemitz ..... 240/2 R

*Primary Examiner*—Stephen J. Lechert, Jr.
*Attorney, Agent, or Firm*—B. R. Studebaker

[57] ABSTRACT

A combination space dividing wall panel and fluorescent lighting fixture wherein the fluorescent lighting fixture is mounted a predetermined distance above the upper edge of the wall panel by a pair of lighting fixture support posts having inverted U-shaped saddle-like members overlying the upper horizontal edge of the wall panel. The support posts extend into threaded apertures in the underside of the lighting fixture and are variably rotatably positionable therein to provide for either linear alignment of the U-shaped saddle members or an angular relationship therebetween to accommodate interconnected angularly related wall panels as the lighting fixture base support.

10 Claims, 7 Drawing Figures

ILLUMINATED SPACE DIVIDING WALL PANEL SYSTEM

BACKGROUND OF THE INVENTION

The open office plan or office landscape system, as it is sometimes referred to, has made a tremendous impact on office construction over the last five to ten years. Probably the biggest factor contributing to the popularity of the open office plan is its susceptibility to change as the needs and the functions of the operation utilizing the office space changes from time to time. Office efficiency is also greatly improved since the office spaces, because of the mobility of the partition systems, can be designed to accommodate the organization rather than the organization being required to be fitted into a fixed office system. A typical space dividing system for an open office plan is disclosed in U.S. Pat. No. 3,762,116 to William C. Anderson et al for Space Divider System and Connector Assembly Therefor.

One drawback to the open office system has been its ability to provide both task lighting for the individual workers as well as overall illumination for the office system. Most open office plans are lighted directly from the ceiling through geometrically spaced fluorescent lighting fixtures mounted within the ceiling at fixed intervals. The spacing of these lighting fixtures generally has no relationship to the office layout. Even where the lighting fixture layout in the ceiling bears some relationship to the original office plan, in just a few years, through rearrangement of the office plan below, the fixed luminaires are no longer strategically placed. One attempt to solve this problem is disclosed in U.S. Pat. No. 3,389,246 to S. R. Shemitz for "Illuminated Wall Partition Divider". In this system the lighting fixtures provide both downwardly directed task lighting and upwardly directed indirect overall lighting but the fluorescent luminaries are mounted directly to the panels and are essentially a part thereof and therefore are limited to providing their principal down lighting adjacent the wall panel in close proximity thereto. Although this system is a step in the right direction, its limitation as to mounting height being controlled by panel height and its inflexibility with regard to where the task lighting can be provided within the office space, renders it somewhat inflexible.

An additional advantage of a lighting system tied to the panel divider system itself rather than a lighting system disposed in the plant or office ceiling is the substantial savings in both energy utilization and cost. For example, one cost study of a 10,000 square ft. office area utilizing a combination space dividing wall panel and a fluorescent lighting fixture system constructed in accordance with this invention, when compared to a typical ceiling lighted system using a rate of 5¢ per kilowatt hour, reduces the cost of energy from $8,190. per year to $3,276. per year, a significant savings in both dollars and energy.

SUMMARY OF THE INVENTION

This invention relates to lighting systems for open office plans and more particularly to a space dividing wall panel and lighting fixture combination which is exemplified by a versatile connecting support means. The abovedescribed deficiencies in the lighting of open office plans have been obviated by the present invention by providing in combination at least one planar vertically oriented space dividing wall panel having an upper horizontal edge portion and an elongated lighting fixture spaced above and overlying at least in part the upper horizontal edge portion of the space dividing wall panel or panels. The elongated lighting fixture includes a pair of spaced connecting means on the underside thereof which have associated therewith a pair of lighting fixture support means which include inverted Ushaped saddles constructed and arranged to associate with the upper horizontal edge portion of the space dividing panel. The lighting fixture support means can interconnect with one or more space dividing wall panels and can mount the lighting fixture above two angularly associated wall panels with the angle between the wall panels being not more than 180° nor less than 90°. A threaded connection between the upper end of the support post and the apertures in the underside of the elongated fluorescent lighting fixture provide for this versatile orientation.

BRIEF DESCRIPTION OF THE DRAWINGS

Many of the attendant advantages of the present invention will become more readily apparent and better understood as the following detailed description is considered in connection with the accompanying drawings, in which.

DESCRIPTION OF THE PREFERRED EMBODIMENTS

Figure 1:
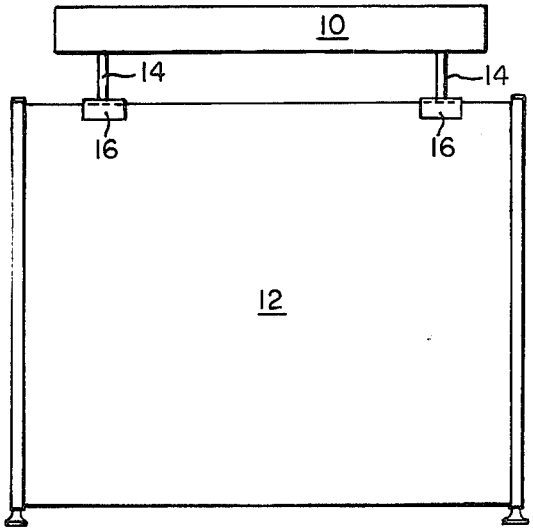
FIG. 1 is a side elevation view of the combination lighting fixture and wall panel of this invention.
Figure 2:
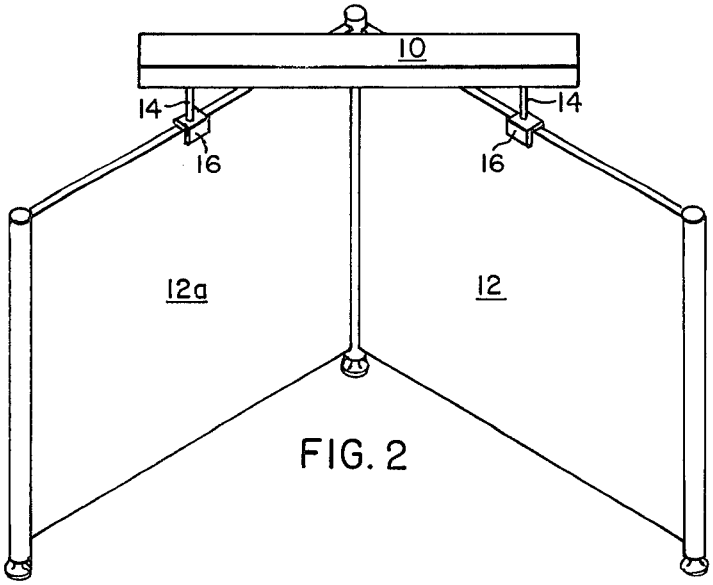
FIG. 2 is an isometric view of a lighting fixture combined with a pair of angularly associated wall panels in accordance with this invention.
Figure 3A:
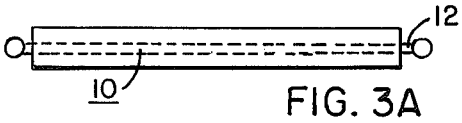
FIGS. 3A, 3B and 3C are top plan views illustrating the combination lighting fixture and support panel of this invention.
Figure 3C:
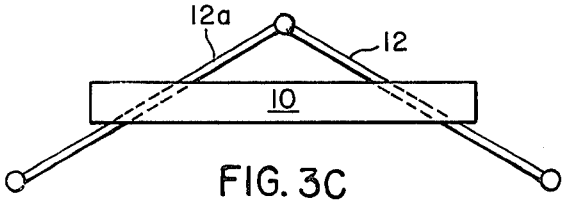

Referring now in detail to the drawings wherein like reference characters represent like parts throughout the several views, there is illustrated in FIGS. 1 through 3C, the versatile lighting fixture wall panel combination of this invention. In FIG. 1 a lighting fixture generally designated 10 is mounted to a single planar wall panel 12 of a space dividing office system by means of a pair of spaced lighting fixture support posts 14 which include inverted U-shaped saddle members 16 which are constructed and arranged to overlie and surround the upper horizontal edge portion of the space dividing wall panel 12. Because of the mechanical interconnection between the top end of the lighting fixture support posts 14 and the complementary spaced connecting means on the underside of the elongated lighting fixture 10, the axis of each of the inverted U-shaped saddle members 16 is variably rotatably positionable with respect to the axis of the lighting fixture. As best seen in FIGS. 2, 3B and 3C, this permits a single lighting fixture 10 to be associated with more than one panel, and to thereby span a portion of the office space defined by a given set of panels.

Figure 3B:
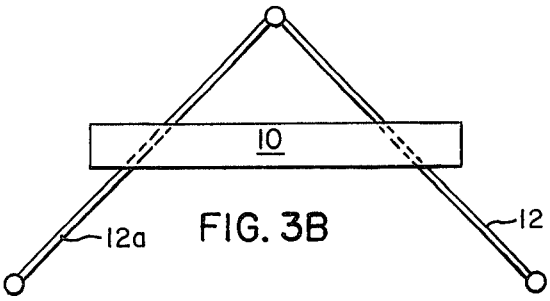

FIG. 2 illustrates isometrically a lighting fixture 10 in combination with a pair of space dividing wall panels 12 and 12a which are set at right angles to each other. FIG. 3B is a top plan view of this configuration; while FIG. 3C is a top plan view of a lighting fixture 10 in combination with a pair of interconnected space dividing wall panels 12 and 12a, which are connected to each other at an angle of approximately 120°. As will also be apparent, a pair of wall panels 12 and 12a may be linearly aligned and a lighting fixture 10 could span that interconnection, if in a specific office design, lighting is required at that location. Additionally, although the lighting fixture 10 and the space dividing wall panels 12 and 12a are combined symmetrically in FIGS. 2, 3B and 3C, it will be equally apparent, as lighting requirements dictate, that the lighting fixture could be asymmetrically located with respect to a pair of angularly interconnected wall panels in a skewed fashion because of the completely free relationship of the axes of the saddle members 16 to the axis of the lighting fixture 10.

Figure 4:
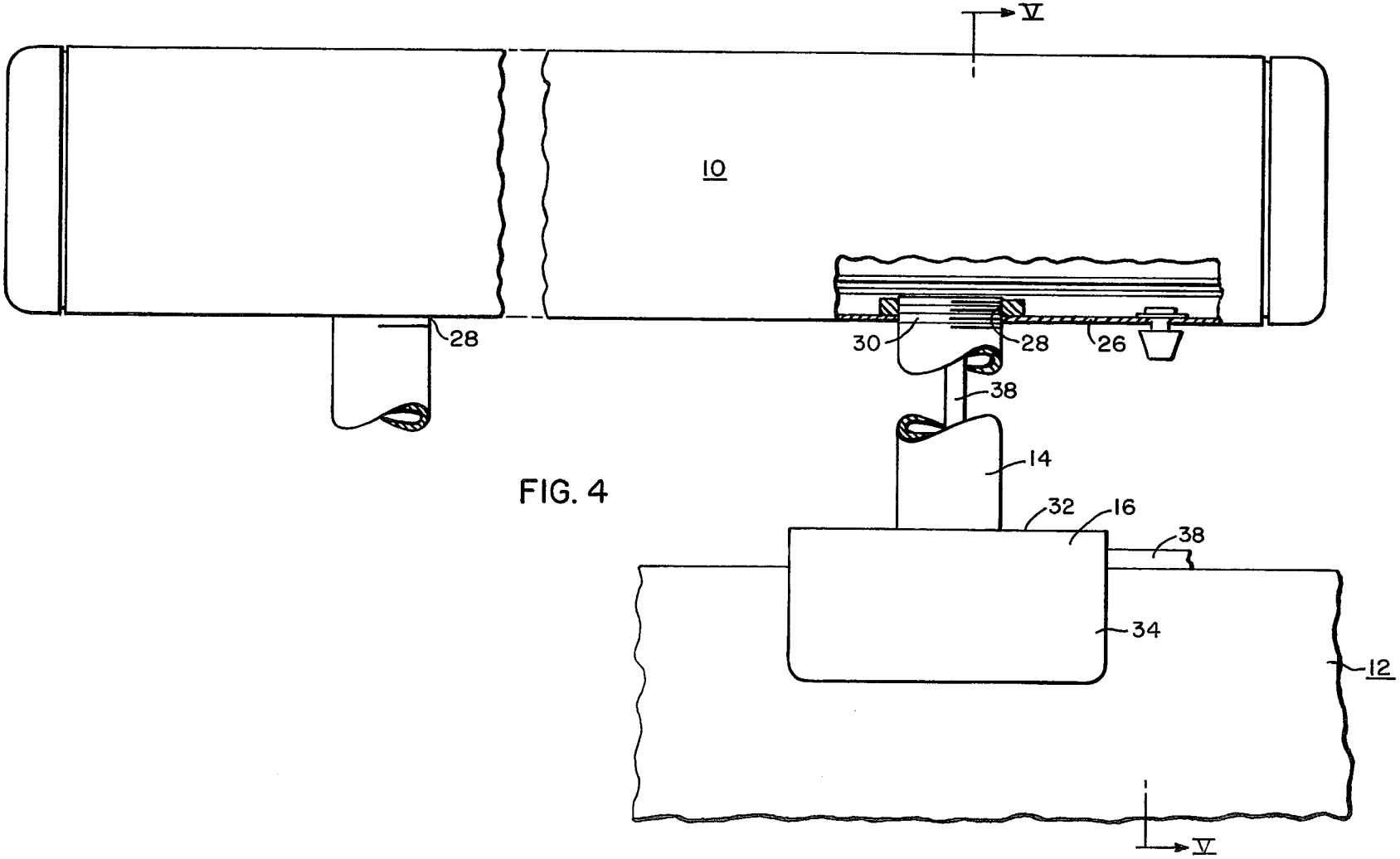
FIG. 4 is a side elevational view, partly in section, of the combination lighting fixture and support post.
Figure 5:
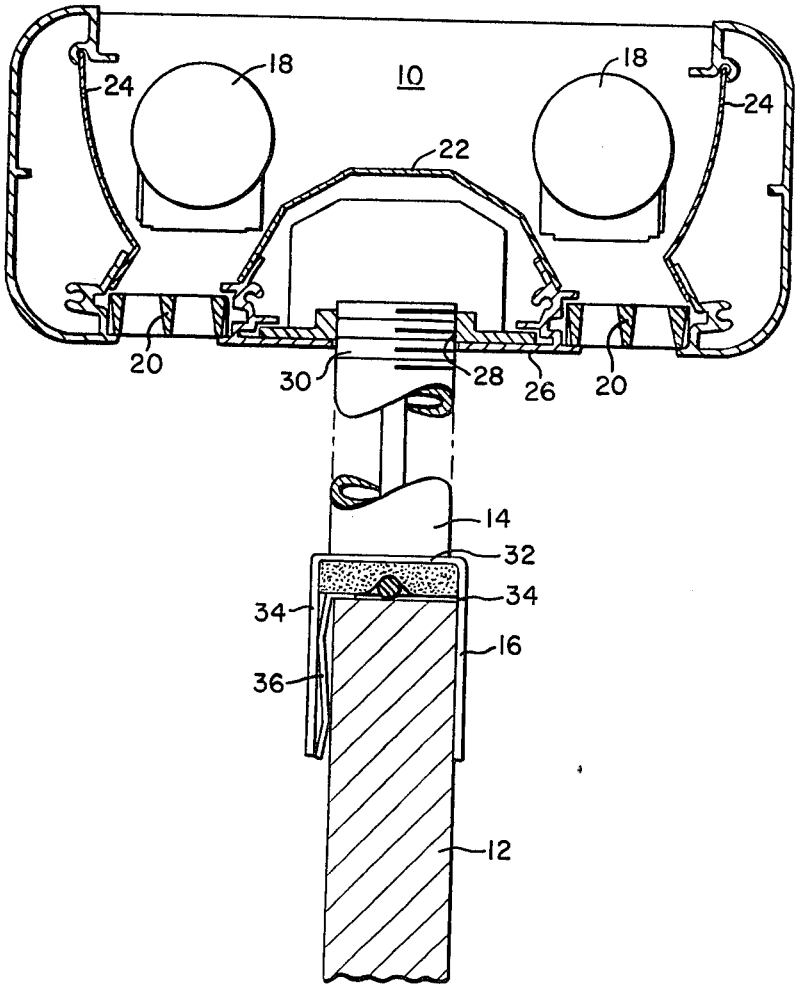
FIG. 5 is a sectional view taken along the line V—V of FIG. 4.

Referring now to FIGS. 4 and 5 wherein a more detailed description of the unique lighting fixture space dividing wall panel combination of this invention is illustrated, the lighting fixture generally designated 10 is a conventional two-way fluorescent lighting fixture which provide both downwardly directed task lighting as well as upwardly directed indirect lighting for general illumination purposes. As best seen in FIG. 5, the lighting fixture 10 includes a pair of fluorescent lamp tubes 18 which provide downwardly directed task lighting through louvered apertures 20 and indirect or upwardly directed light by both direct rays and from the tunnel reflector 22 and side wall reflectors 24. The central bottom wall 26 of the luminaire 10 includes a pair of spaced, threaded apertures 28 which are constructed and arranged to receive the threaded end 30 of the support post 14. The other end of the support post 14 is preferably welded to the top wall of the elongated inverted U-shaped saddle member 16. The saddle side walls 334 surround the space dividing wall panels 12 and are secured thereto in a relatively tight-fitting relationship by a self-adjusting wedge member 36, the operation of which is described in detail in copending application Ser. No. 797,889, for Combination Support Bracket And Self-Adjusting Wedge, filed the same date as this application and owned by the assignee of this application.

Although the mechanical interconnection between the upper end of support posts 14 and the fluorescent lighting fixture 10 is illustrated as a threaded stud and socket combination, it will be apparent that other mechanical interconnections are available, but they must necessarily provide for free rotatability of the post with respect to the lighting fixture in order that the axis of each of the saddle members 16 can be freely angularly oriented with respect to the axis of the lighting fixture.

Electrical power may be provided to the lighting fixture 10 by means of a conventional electrical cord 38 which extends through the hollow support post 14 in accordance with the preferred embodiment.

Most space dividing wall panel systems are generally 60 or 80 inches high to provide minimal privacy as well as a sufficient barrier to sound transmission. In this regard, it has been found that the ideal height for the bottom wall 26 of the fluorescent lighting fixture in most office applications is between 68 and 84 inches above the floor of the open office area in which the space dividing wall panels are situated. Accordingly, the support post 14 is preferably 3 inches in length when employed with an 80 inch wall panel and 8½ inches in length when employed with a 60 inch wall panel. These combinations provide for lighting fixture locations which provide optimum task lighting at desk level as well as good general illumination for the entire open office area from indirect lighting directed at the ceiling of the office space through the top wall of the lighting fixture.

As will be apparent from the foregoing, the combination space dividing wall panel and lighting fixture of this invention provides a versatile lighting system for an open office plan which permits the lighting fixture to be associated with one or more wall panels regardless of the angular orientation between adjacent interconnected wall panels and permits great versatility with regard to locating the light source where task lighting is needed.

What is claimed is:

1. A space dividing wall panel and lighting fixture combination comprising:

at least one planar, vertically oriented, space dividing wall panel having an upper horizontal edge portion, an elongated lighting fixture spaced above and overlying, at least in part, said upper horizontal edge portion of said at least one space dividing wall panel, a pair of spaced connecting means on the underside of said elongated lighting fixture, a pair of lighting fixture support means, said lighting fixture support means each including mounting means at one end thereof constructed and arranged to associate with the upper horizontal edge portion of said space dividing wall panel and complementary connecting means at the other end thereof constructed and arranged to interconnect with one of said spaced connecting means on the underside of said elongated lighting fixture.

2. The combination space dividing wall panel and lighting fixture according to claim 1 wherein said at least one planar vertically oriented space dividing wall panel is a pair of interconnected wall panels, said interconnected wall panels being angularly associated with each other at an angle which is not more than 180° nor less than 90° and one each of said support means is associated with each of said space dividing wall panels.

3. The combination space dividing wall panel and lighting fixture according to claim 1 wherein said mounting means on said one end of said lighting fixture support means is an inverted U-shaped saddle constructed and arranged to overlie said upper horizontal edge portion of said space dividing wall panel.

4. The combination space dividing wall panel and lighting fixture according to claim 3 wherein said spaced connecting means on the underside of said lighting fixture are threaded apertures and said complementary connecting means on the other end of said lighting fixture support means is a threaded stud, thereby permitting angular orientation of said inverted U-shaped saddles with respect to the longitudinal axis of said elongated lighting fixture.

5. A combination space dividing wall panel and lighting fixture comprising:

at least one space dividing wall panel having an upper horizontal edge, said at least one wall panel adapted for subdividing an open office area, an elongated fluorescent lighting fixture spaced above and overlying at least a portion of said upper horizontal edge of said at least one space dividing wall panel, said elongated fluorescent lighting fixture including at least two apertures in the underside thereof, a pair of lighting fixture support posts, said lighting fixture support posts including inverted U-shaped saddle members at one end thereof positionable over said upper horizontal edge of said space dividing panel and connecting means at the other end thereof constructed and arranged to connect with said apertures in the underside of said elongated fluorescent lighting fixture.

6. The combination according to claim 5 wherein female threads are provided in said apertures in the underside of said fluorescent lighting fixture and said connecting means at the other end of said lighting fixture support posts include male threads receivable in said female threads in said apertures whereby said inverted U-shaped saddle means are variably angularly positionable with respect to the longitudinal axis of said elongated fluorescent lighting fixture.

7. The combination according to claim 6 wherein said at least one space dividing wall panel is a pair of interconnected wall panels, said interconnected wall panels being angularly associated with each other at an angle which is not more than 180° and not less than 90° and one of said pair of said lighting fixture support posts is mounted on each of said interconnected wall panels.

8. The combination according to claim 5 wherein the underside of said lighting fixture is between 68 and 84 inches above the floor of said open office area in which said space dividing panel is situated.

9. A combination space dividing wall panel and lighting fixture comprising:

at least one space dividing wall panel having an upper horizontal edge, said at least one wall panel adapted for subdividing an open office area, an elongated fluorescent lighting fixture spaced above and overlying at least a portion of said upper horizontal edge of said at least one space dividing panel, said elongated fluorescent lighting fixture including at least two apertures in the underside thereof, each of said apertures having female threads on the inner surface thereof, a pair of lighting fixture support posts, said lighting fixture support posts including inverted U-shaped saddle members at one end thereof positionable over said upper horizontal edge of said space dividing wall panel, and connecting means including male threads thereon at the other end of said lighting fixture support posts, said male threads being receivable in said female threads in said apertures whereby said inverted U-shaped saddle members are variably angularly positionable with respect to the longitudinal axis of said elongated fluorescent lighting fixture.

10. The combination according to claim 9 wherein said at least one space dividing wall panel is a pair of interconnected wall panels, said interconnected wall panels being angularly associated with each other at an angle which is not more than 180° and not less than 90° and one of said pair of said lighting fixture support posts is mounted on each of said interconnected wall panels.

* * * * *